United States Patent [19]

Chadshay

[11] 4,454,892

[45] Jun. 19, 1984

[54] ATOMIZING OIL VALVE IMPROVEMENT

[75] Inventor: Roman Chadshay, Windsor, Conn.

[73] Assignee: Combustion Engineering, Inc., Windsor, Conn.

[21] Appl. No.: 417,011

[22] Filed: Sep. 13, 1982

[51] Int. Cl.[3] ..... F16K 11/16

[52] U.S. Cl. ..... 137/597; 137/630.22; 137/625.5; 137/625.27

[58] Field of Search ..... 137/625.5, 625.27, 597, 137/625.49, 625.17; 251/121, 120, 119, 118

[56] References Cited

U.S. PATENT DOCUMENTS 4,146,056 3/1979 Buchanan ..... 137/597 X

*Primary Examiner*—Martin P. Schwadron
*Assistant Examiner*—John S. Starsiak, Jr.
*Attorney, Agent, or Firm*—Arthur L. Wade

[57] ABSTRACT

A 3-position valve simultaneously supplies oil to a burner and supplies steam/air as an atomizing medium for the oil. The vapor valve element and oil valve element are positioned relative to their seats by a common stem system. After the oil valve element is seated and the oil thereby shut off, a position is given the vapor valve element to flow the vapor as a purging medium principally through the oil outlet line from the valve to the burner.

4 Claims, 4 Drawing Figures

ATOMIZING OIL VALVE IMPROVEMENT

TECHNICAL FIELD

The present invention relates to the supply of atomizing steam/air as a purging vapor medium for an oil line to its burner following shutdown. More particularly, the invention relates to restricting the atomizing vapor outlet from the valve body cavity during the Purge position to provide an adequate flow or purging vapor to the oil outlet line from the valve cavity during burner shutdown.

BACKGROUND ART

It is common to provide a single valve body to simultaneously supply the oil to a burner and vapor to atomize the oil. The vapor and the oil are controlled through their respective seats by separate movable valve elements within the cavity of the valve body. There are two basic positions of these valve elements. First, in the Run position, the oil valve element has been moved from its seat to enable the oil to flow through the cavity to the burner. At the same time, the vapor valve element has been moved from its seat to provide only the atomizing vapor outlet from the cavity as a route for the vapor. Alternatively, of course, both valve elements engage their respective seats to preclude passage of both oil and vapor through the cavity to the burner. A third position is provided for the elements which maintains the oil isolated from the burner while the vapor is flowed to both the oil outlet and the vapor outlet.

A valve construction representative of the arrangement described above is manufactured by Skotch, Inc., 278 Main Street, Portland, Conn. 06480. The valve is presently marketed under the trademark "Trifecta" and it has its valve elements, seats and vapor outlet positioned to provide less than a desirable amount of vapor to the oil outlet line during the purge position. There is need for a structure, at the vapor outlet from the body cavity, formed and arranged to provide a predetermined restriction to the flow of the vapor from the cavity through the atomizing vapor line. So restricted, the vapor within the cavity will be divided between the vapor outlet line and oil outlet line to adequately purge the oil outlet line to the burner.

DISCLOSURE OF THE INVENTION

The present invention provides for a 2-element valve in which the elements are positioned to supply the flow of atomizing/purging vapor and oil to a burner wherein a sleeve is provided for the atomizing vapor line from the cavity which will restrict the flow of vapor from the cavity into the atomizing vapor line so that a predetermined amount of vapor will flow from the cavity to the burner.

Other objects, advantages, and features of the invention will become apparent to one skilled in the art upon consideration of the written specification, appended claims and accompanying drawings.

BRIEF DESIGNATION OF THE DRAWINGS

BEST MODE FOR CARRYING OUT THE INVENTION

Terms and Technology

In the broad sense, a valve is essentially a body with a cavity through which fluid is supplied. An inlet directs the fluid into the cavity and an outlet flows the fluid from the cavity. Within the cavity, between the inlet and outlet, is some form of aperture referred to as a seat. A movable element within the cavity restricts or prevents fluid flow through the aperture and, therefore, from the inlet to the outlet. This movable valve element is positioned by a stem which protrudes from the outside of the body and is actuated by any number of mechanisms. Thus, is generated the terms seat, valve element, and stem.

Of course, a plurality of valve elements within the cavity may cooperate with multiple seats to route multiple fluids through the cavity of the body. The present invention is embodied in the valve whose cavity is divided by three seats, the seats cooperating with the two valve elements, and both elements actuated by a common stem system.

The valve is more completely characterized as providing a stem system for the two valve elements. Thus, while both valve elements can be seated to prevent flow of either steam/air or oil and a second position permits flow of both fluids, a third position is provided wherein the oil valve element is seated to prevent the flow of oil through the valve while the steam/air valve element permits the flow of this vapor through its seat to both the vapor outlet and the oil outlet for the purposes of purging these conduits from the valve to their burner. An essential element of the invention is the means with which the vapor outlet from the cavity is restricted in the Purge position of both elements to highly restrict the vapor flow through the vapor outlet of the valve and, thus, route the bulk of the vapor to the oil outlet in purging the line of liquid residue.

This disclosure will refer to the medium used to atomize the oil and purge the lines between the valve and burner as steam/air, vapor, and medium. It is to be understood, for the purposes of disclosing the present invention, that these terms all refer to the same fluid, i.e. that material with which the oil is atomized and the lines purged. In short, the terms are not employed in any limiting sense relative to the invention.

General Organization

Each of the first three drawings disclose the same valve body cavity, seats dividing that cavity, and inlets and outlets to and from the cavity. Each figure shows a different position for the two valve elements which cooperate with cavity-dividing seats.

Figure 1:
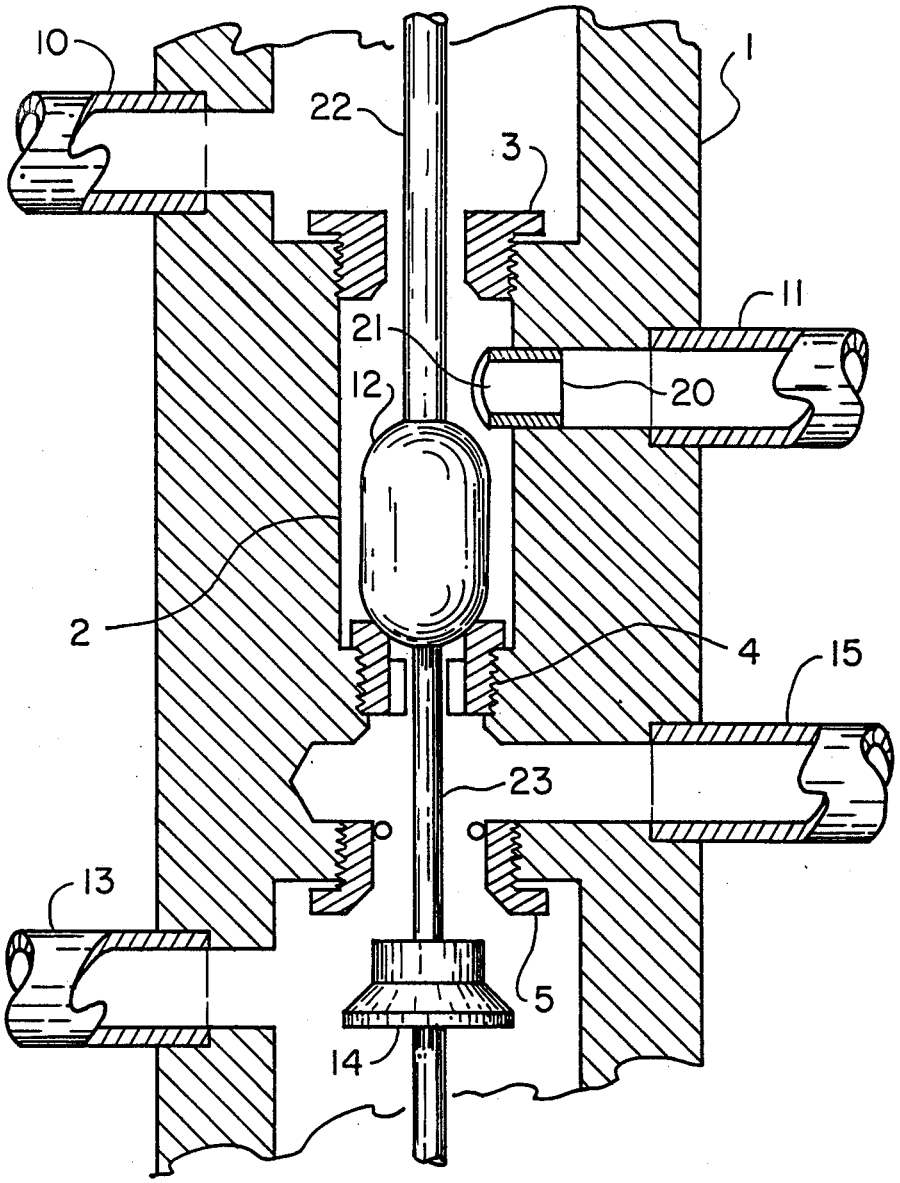
FIG. 1 is a sectioned elevation of a valve cavity and elements supplying atomizing vapor and oil to a burner and embodying the present invention.
Figure 2:
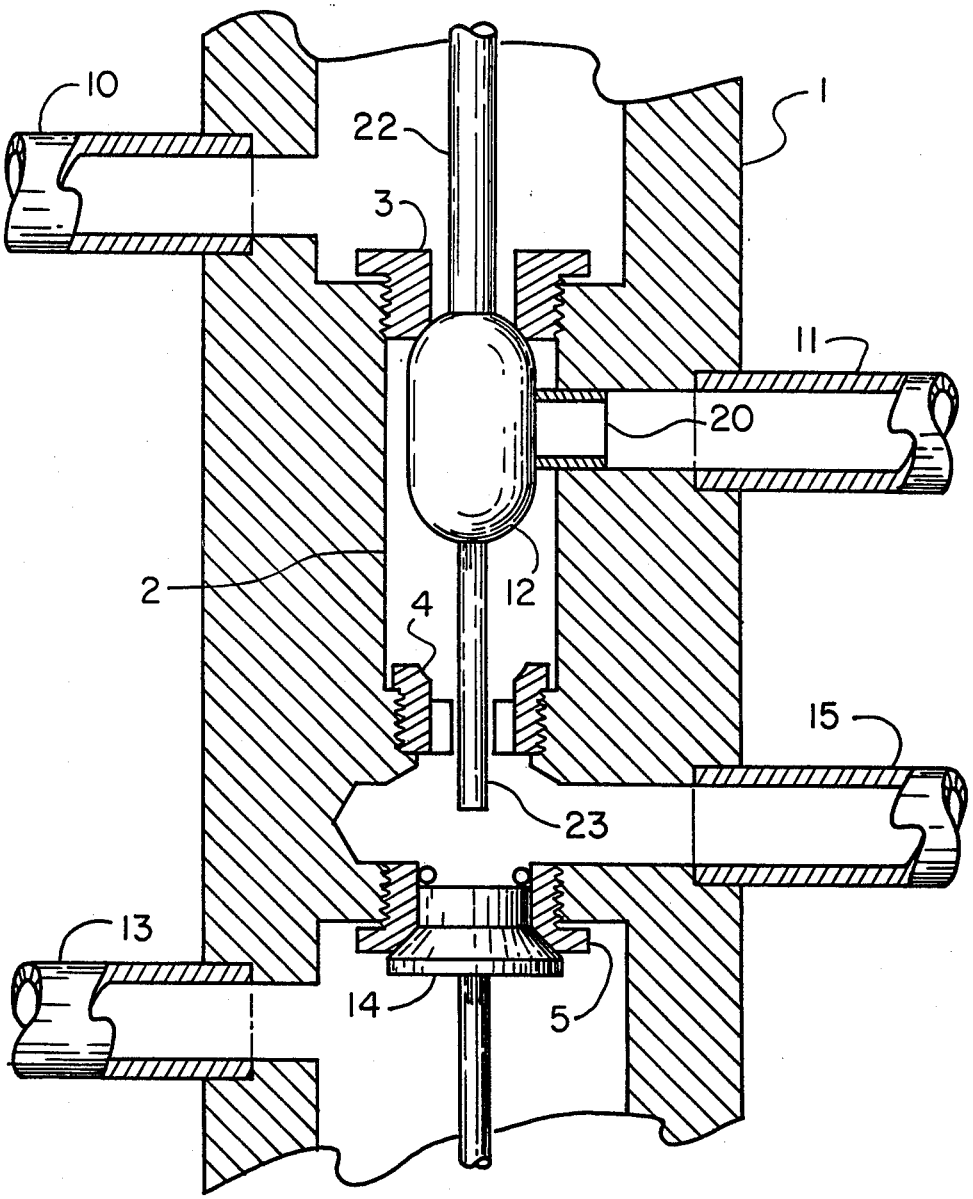
FIG. 2 is the cavity and elements of FIG. 1 in their Shutdown position.
Figure 3:
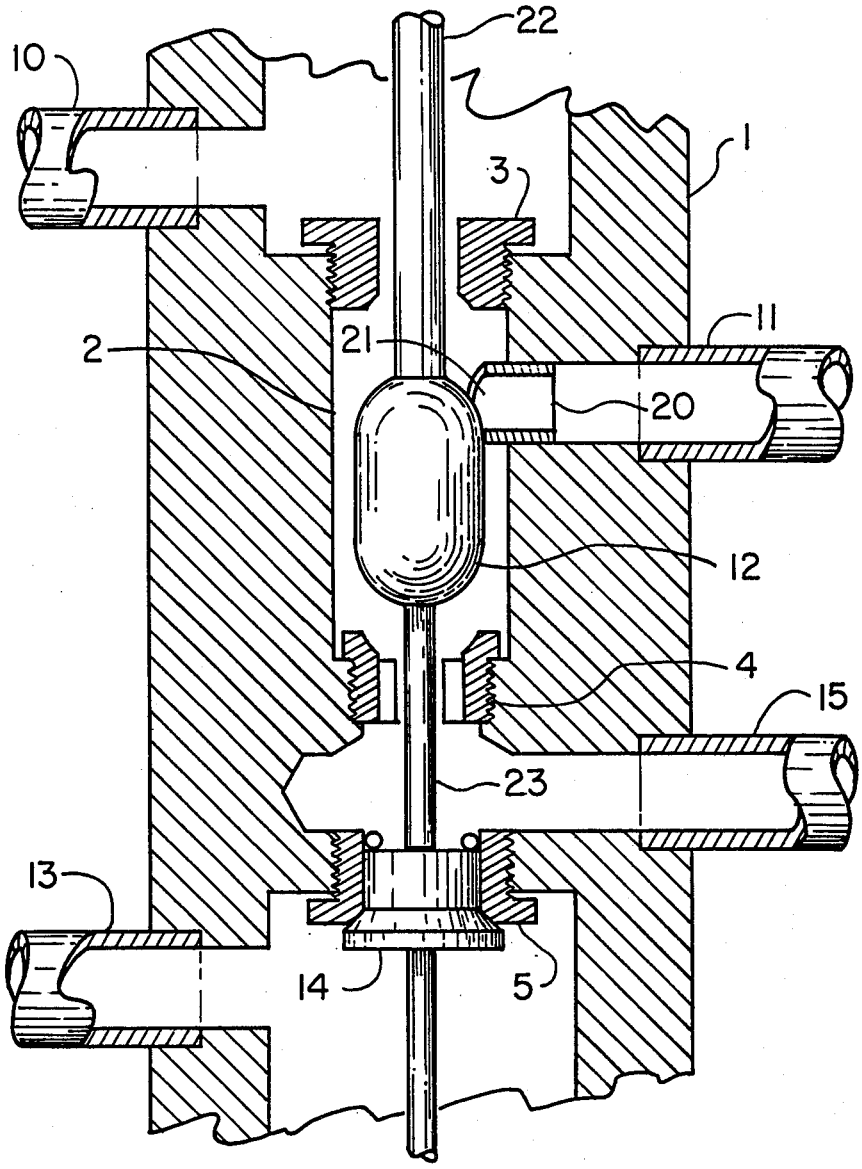
FIG. 3 is the cavity and elements of FIG. 1 in their Purge position.

Arbitrarily, FIG. 1 discloses the valve elements which place the system in the "Run" position. FIG. 2 shows the valve elements in the "Shutdown" position. FIG. 3 shows the valve elements in the "Purge" position.

Referring specifically to FIG. 1, valve body 1 has its cavity 2 divided by vapor seat 3, parition seat 4, and oil seat 5. Although it is obvious from simple inspection, it is pointed out that vapor inlet conduit 10 introduces a vapor, such as steam or air, into cavity 2 above the vapor seat 3. The vapor which flows down through the seat 3 then flows from the cavity out vapor outlet conduit 11. Of course, this flow of vapor through the seat is permitted by the disengagement of vapor valve element 12 from the vapor seat.

While vapor is flowing through cavity 2 as an atomizing medium for oil supplied the burner, oil is also flowing through cavity 2. Specifically, the oil flows through the oil inlet conduit 13, into the cavity, below the oil seat 5, and out of the cavity when the oil valve element 14 is disengaged from oil seat 5, through the oil outlet 15. Both vapor conduit 11 and oil conduit 15 extend to the burner (not shown). The vapor of conduit 11 atomizes the oil from conduit 15 at the burner as combustion takes place. In the Run position, vapor valve element 12 is engaging partition seat 4. By engagement of the partition seat 4 with the vapor valve element 12, the cavity is divided into an upper portion and a lower portion. Therefore, all of the vapor of inlet 10 passes out conduit 11 for atomizing oil at the burner.

Shutdown

The foregoing Run position of the valve establishes that the burner (not shown) supports combustion by it being supplied fuel, atomized by vapor. The operation of the burner, in its consumption of fuel and the atomization of that fuel, is of limited concern in disclosing the present invention. The full cycle of valve operation is disclosed to open the curtain on the form and operation of the present invention which enhances purging of the fuel line after shutdown. The Shutdown position is taken up in FIG. 2 as the basic alternate position. Both the atomizing vapor and the oil have their flow through the body cavity of the valve terminated when combustion at the burner is no longer required.

In FIG. 2, the vapor valve element 12 and oil valve element 14 are positioned to engage their respective seats, and oil no longer flows through seat 5. This alternate position is clearly disclosed in FIG. 2. Therefore, the first two figures clearly show the basic alternate positions of the valve elements 12 and 13 within the cavity of the valve body. It is in FIG. 3 that the invention comes into play. Following the Shutdown position of FIG. 2, vapor valve element 12 is positioned downward far enough to disengage seat 3, but fails short of engaging seat 5. This third position will be termed the Purge position.

Purge Position

In FIG. 3, the valve stem system for the two valve elements is actuated to lower vapor valve element 12 from its seat on the vapor seat. Vapor enters above the valve seat and flows downward through the seat. As vapor valve element 12 is not seated on seat 4, the vapor flows to both vapor outlet conduit 11 and oil outlet conduit 15. Up to this point, arrangement and operation of the valve, i.e. the relation of the valve elements to their seats, follows the operation of the prior art. Without the present invention, the vapor, through its seat 3, is divided into parallel flows out the vapor conduit and out the oil conduit. The purpose of these flows is to purge both conduits of residue so that an accumulation of the residue will not build up during the Shutdown period. However, giving parallel access to the vapor through conduits of approximately equal size will result in an inadequate flow of the vapor through oil conduit 13. Purging of the oil conduit has not been satisfactory. The present invention is embodied in structure which restricts the vapor flow through the outlet conduit 11 and, thereby, forces a larger, adequate, supply of vapor down the oil conduit 15. It is the difficulty in providing the required restriction that makes the present invention an important improvement in this type of valve.

Embodiment Of The Invention

Thus far, I have pointed to the defect in the prior art and indicated the location of structure needed to remedy the defect. I have also spoken to the function of the structure needed to remedy the defect. All that is required of the structure is to restrict the flow of vapor out of the valve body cavity to the atomizing vapor conduit 11. To restrict the vapor flow out of conduit 11 is to increase the vapor flow out of conduit 15. Thus, the oil residue in the conduit 15 will be flushed from the valve body cavity toward the burner.

Figure 4:
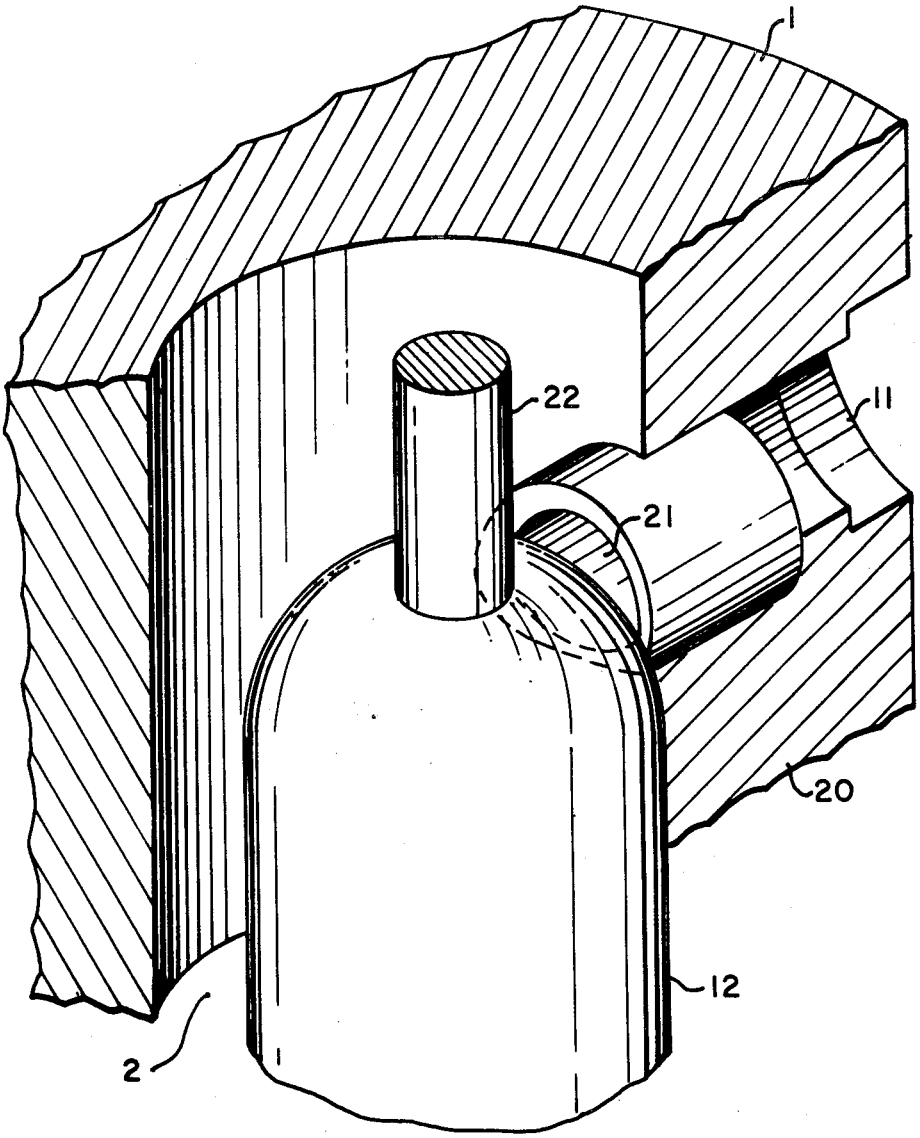
FIG. 4 is a sectioned isometric of the upper part of the valve cavity.

The restricting structure can take many forms. The structure I disclosed is to be taken as representative of all means restricting vapor at this position. Specifically, I disclose a sleeve, insert, or ring which is mounted in the outlet of conduit 11. This sleeve 20, in the form of a cylinder, is mounted to extend back into the body cavity far enough to form a small space between it and the vapor valve element. The end of the sleeve and the wall of the valve element thus forms a relatively small passage for vapor from the cavity into the outlet conduit 11. Although FIGS. 1, 2 and 3 indicate the location of this insert, FIG. 4 gives a more detailed disclosure.

In plan, the vapor valve element is discernible as cylindrical in cross section, its vertical walls spaced from the end of the insert or sleeve 20. Note, it is only during the Purge position of the vapor valve element that the restrictive passage is formed. In the Run position of FIG. 1, the vapor valve element is lowered below the end of the insert sleeve 20 to engage the valve element with partition seat 4. Thus, in the Run position, all of the vapor for atomization flows into the atomizing fluid conduit 11 and to the burner.

In the Shutdown position, the vapor valve element engages the lower side of vapor seat 3. No vapor can flow into the body cavity or out of the body cavity.

It is in the Purge position of the vapor valve element that the vapor flows through seat 3 and is available to both the vapor outlet conduit 11 and the oil outlet conduit 15. It is in this position that the present invention, embodied in the insert sleeve 20, establishes a relatively small passage at 21 which functions to restrict the vapor flow into the atomizing vapor conduit 11 and thus divert an adequate amount of the vapor to the oil outlet conduit 15.

Conclusion

There are many details of practical construction of the valve which have not been disclosed in the drawings. The source of vapor and fuel oil are evidenced only by their conduits 10 and 13. The destination of vapor outlet conduit 11 and oil outlet coduit 15 is, of course, a burner which has not been depicted. Then, there is the means for moving the vapor valve element 12 and oil valve element 14. Only the upper stem portion 22 is assumed to be connected to such means. Finally, no discussion has been given to the cooperation of stem portion 22 and lower stem portion 23. It should be evident that guides for these stems must be supplied to maintain the travel of valve elements 12 and 14 in a straight vertical path.

In analyzing the valve as the 3-position valve, it takes no great imagination to realize that the lower oil valve element 14 should have a structure equivalent to a spring to seat the valve element and thereby terminate oil flow through the body cavity when upper vapor valve element 12 is seated to terminate vapor flow through the cavity. Then, when valve stem portion 22 is moved downward by its unseen actuating mechanism, the lower end of this stem portion will engage the upper end of stem portion 23 to unseat the oil valve element when the vapor valve element engages the partition seat 4. Finally, when the all-important Purge position is taken, valve element 12 is disengaged from seat 4 and placed in a restricting relationship with the end of insert sleeve 20. In this Purge position, the invention predetermines the amount of vapor allocated to each of conduits 11 and 15 to insure the purge of conduit 15, the fundamental end result sought by the invention.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. An atomizing oil valve, including, a valve body, a cavity within the valve body, a vapor inlet to the cavity, a vapor outlet from the cavity, a seat within the cavity between the vapor inlet and vapor outlet, a first valve element movable into and out of engagement with the vapor seat, an oil inlet to the cavity, an oil outlet from the vavle cavity, a seat within the cavity between the oil inlet and oil outlet, a second valve element movable into and out of engagement with the oil seat, a stem system arranged to extend into the valve cavity and move both valve elements relative to their respective seats, and an extension structure from the vapor outlet conduit arranged within the cavity to cooperate with the vapor valve element to form a passage from the cavity into the vapor outlet conduit predetermined in size to restrict the flow of vapor from the cavity into the vapor outlet conduit so that a predetermined quantity of vapor will be forced from the cavity out through the oil outlet conduit when the oil valve element is seated.

2. The valve of claim 1, wherein, the extension of the vapor outlet conduit is in the form of a cylindrical sleeve mounted by a first end in the vapor outlet conduit and extending its second end into the cavity to within a predetermined distance of the vapor valve element.

3. An atomizing oil valve, including, a valve body, a cavity within the valve body, a vapor inlet to the cavity, a vapor outlet from the cavity, a seat within the cavity between the vapor inlet and vapor outlet, a first valve element movable into and out of engagement with the vapor seat, an oil inlet to the cavity, an oil outlet from the valve cavity, a seat within the cavity between the oil inlet and oil outlet, a second valve element movable into and out of engagement with the oil seat, a stem system arranged to extend into the valve cavity and move both valve elements relative to their respective seats, and a structure mounted at the vapor outlet conduit to extend into the body cavity and cooperate with the first valve element to restrict the flow of vapor into the vapor outlet conduit, whereby the vapor flow restriction out the vapor outlet conduit diverts a predetermined portion of the vapor flow out the oil outlet conduit.

4. The valve of claim 3, wherein, the restriction structure is in the form of a cylinder mounted in the vapor outlet conduit and extending its open end to within a predetermined distance of the first valve element.

* * * * *